US006157304A

United States Patent [19]

Bennett et al.

[11] Patent Number: 6,157,304

[45] Date of Patent: Dec. 5, 2000

[54] POOL ALARM SYSTEM INCLUDING MOTION DETECTORS AND A DRAIN BLOCKAGE SENSOR

[76] Inventors: Michelle S. Bennett; Gene Forsythe, both of 855 E. Baylor La., Gilbert, Ariz. 85296

[21] Appl. No.: 09/388,423

[22] Filed: Sep. 1, 1999

[51] Int. Cl.[7] ..... G08B 23/00

[52] U.S. Cl. ..... 340/573.6; 340/573; 340/573.1; 340/573.4; 340/531; 340/522

[58] Field of Search ..... 340/573.6, 573.1, 340/573.4, 573, 566, 531, 522, 506, 544

[56] References Cited

U.S. PATENT DOCUMENTS

| | | | |
|---|---|---|---|
| 5,019,802 | 5/1991 | Brittain et al. | 340/522 |
| 5,115,222 | 5/1992 | Peralta et al. | 340/573 |
| 5,369,623 | 11/1994 | Zerangue | 367/93 |
| 5,486,814 | 1/1996 | Quinones | 340/573 |
| 5,548,275 | 8/1996 | Shambayati et al. | 340/573 |
| 5,619,187 | 4/1997 | Serfontein | 340/573 |
| 5,631,630 | 5/1997 | McSweeney | 340/522 |
| 5,638,048 | 6/1997 | Curry | 340/552 |
| 5,730,861 | 3/1998 | Sterghos et al. | 210/86 |
| 5,828,304 | 10/1998 | Mowday | 340/566 |

*Primary Examiner*—Daniel J. Wu
*Assistant Examiner*—Hung Nguyen
*Attorney, Agent, or Firm*—Joseph N. Breaux

[57] ABSTRACT

A pool alarm system including a programmable control circuit, a control keypad, a number of planar focused infrared motion detectors, a key alarm system activation switch, an audible alarm output system, a drain blockage sensor, and a pool pump motor control relay. The drain blockage sensor is installed in place of the existing drain cover and includes a perforated dome shaped cover member slidably mounted to a compression detector including a spring biased plunger slidably mounted within a plunger cylinder. The spring biased plunger has a permanent magnet secured to a plunger bottom surface thereof. The plunger cylinder has a magnetically actuated reed switch in electrical connection with a drain stoppage input of the programmable control circuit and positioned on a bottom cylinder surface thereof. Each of the number of planar focused infrared motion detectors has an infrared sensing area having a planar bottom to allow for sensing motion at or a near a pool water surface.

1 Claim, 2 Drawing Sheets

POOL ALARM SYSTEM INCLUDING MOTION DETECTORS AND A DRAIN BLOCKAGE SENSOR

TECHNICAL FIELD

The present invention relates to pool safety devices and more particularly to a pool alarm system that includes a programmable control circuit, a control keypad, a number of planar focused infrared motion detectors, a key alarm system activation switch, an audible alarm output system, a drain blockage sensor, and a pool pump motor control relay; the programmable control circuit including a keypad input in connection with the control keypad, a number of motion detector inputs, each in connection with one of the number of planar focused infrared motion detectors, a circuit activation input in connection with the key alarm system activation switch, a speaker drive output in connection with the audible alarm output system, a drain stoppage input in connection with the drain blockage sensor, and a pump motor control output in connection with the pool pump motor control relay; each of the number of planar focused infrared motion detectors having an infrared sensing area having a planar bottom to allow for sensing motion at or a near a pool water surface; each of the planar focused infrared motion detectors generating an alarm trigger signal to one of the motion detector inputs of the programmable control circuit when motion is detected in the infrared sensing area; the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch; a force generated by pump suction being sufficient to pull the perforated dome shaped cover member downward to a triggering position when the perforations through the perforated dome shaped cover member are blocked by a trapped child or pet; the programmable control circuit being programmed to generate an audible alarm on the speaker drive output in connection with the audible alarm output system after receiving the alarm trigger signal from one of the planar focused infrared motion detectors on an infrared detector input; the programmable control circuit being programmed to open the pump motor control relay to disable a pool pump and to generate an audible alarm on the speaker drive output when a drain blocked signal is received on the drain stoppage input from the drain blockage sensor.

BACKGROUND ART

Every year children and pets drown in unmonitored swimming pools. It would be a benefit, therefore, to have a pool monitoring and alarm system that monitored movement through a detecting zone near or at the pool water surface to detect when items enter the pool. In addition, children can become stuck against the drain intake of a pool and be unable to break free because the suction generated by the pool pump is too great. It would be a further benefit, therefore, to have a pool alarm and monitoring system that included a sensor for detecting when the pool drain becomes blocked and automatically turns the pool pump off to release the trapped child while simultaneously activating an audible alarm to attract rescue efforts.

GENERAL SUMMARY DISCUSSION OF INVENTION

It is thus an object of the invention to provide a pool alarm system that includes a programmable control circuit, a control keypad, a number of planar focused infrared motion detectors, a key alarm system activation switch, an audible alarm output system, a drain blockage sensor, and a pool pump motor control relay; the programmable control circuit including a keypad input in connection with the control keypad, a number of motion detector inputs, each in connection with one of the number of planar focused infrared motion detectors, a circuit activation input in connection with the key alarm system activation switch, a speaker drive output in connection with the audible alarm output system, a drain stoppage input in connection with the drain blockage sensor, and a pump motor control output in connection with the pool pump motor control relay; each of the number of planar focused infrared motion detectors having an infrared sensing area having a planar bottom to allow for sensing motion at or a near a pool water surface; each of the planar focused infrared motion detectors generating an alarm trigger signal to one of the motion detector inputs of the programmable control circuit when motion is detected in the infrared sensing area; the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch; a force generated by pump suction being sufficient to pull the perforated dome shaped cover member downward to a triggering position when the perforations through the perforated dome shaped cover member are blocked by a trapped child or pet; the programmable control circuit being programmed to generate an audible alarm on the speaker drive output in connection with the audible alarm output system after receiving the alarm trigger signal from one of the planar focused infrared motion detectors on an infrared detector input; the programmable control circuit being programmed to open the pump motor control relay to disable a pool pump and to generate an audible alarm on the speaker drive output when a drain blocked signal is received on the drain stoppage input from the drain blockage sensor.

Accordingly, a pool alarm system is provided. The pool alarm system includes a programmable control circuit, a control keypad, a number of planar focused infrared motion detectors, a key alarm system activation switch, an audible alarm output system, a drain blockage sensor, and a pool pump motor control relay; the programmable control circuit including a keypad input in connection with the control keypad, a number of motion detector inputs, each in connection with one of the number of planar focused infrared motion detectors, a circuit activation input in connection with the key alarm system activation switch, a speaker drive output in connection with the audible alarm output system, a drain stoppage input in connection with the drain blockage sensor, and a pump motor control output in connection with the pool pump motor control relay; each of the number of planar focused infrared motion detectors having an infrared sensing area having a planar bottom to allow for sensing motion at or a near a pool water surface; each of the planar focused infrared motion detectors generating an alarm trigger signal to one of the motion detector inputs of the programmable control circuit when motion is detected in the infrared sensing area; the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch; a force generated by pump suction being sufficient to pull the perforated dome shaped cover member downward to a triggering position when the perforations through the perforated dome shaped cover member are blocked by a trapped child or pet; the programmable control circuit being programmed to generate an audible alarm on the speaker drive output in connection with the audible alarm output system after receiving the alarm trigger signal from one of the planar focused infrared motion detectors on an infrared detector input; the programmable control circuit being programmed to open the pump motor control relay to disable a pool pump and to generate an audible alarm on the speaker drive output when a drain blocked signal is received on the drain stoppage input from the drain blockage sensor.

BRIEF DESCRIPTION OF DRAWINGS

For a further understanding of the nature and objects of the present invention, reference should be made to the following detailed description, taken in conjunction with the accompanying drawings, in which like elements are given the same or analogous reference numbers and wherein.

EXEMPLARY MODE FOR CARRYING OUT THE INVENTION

Figure 1:
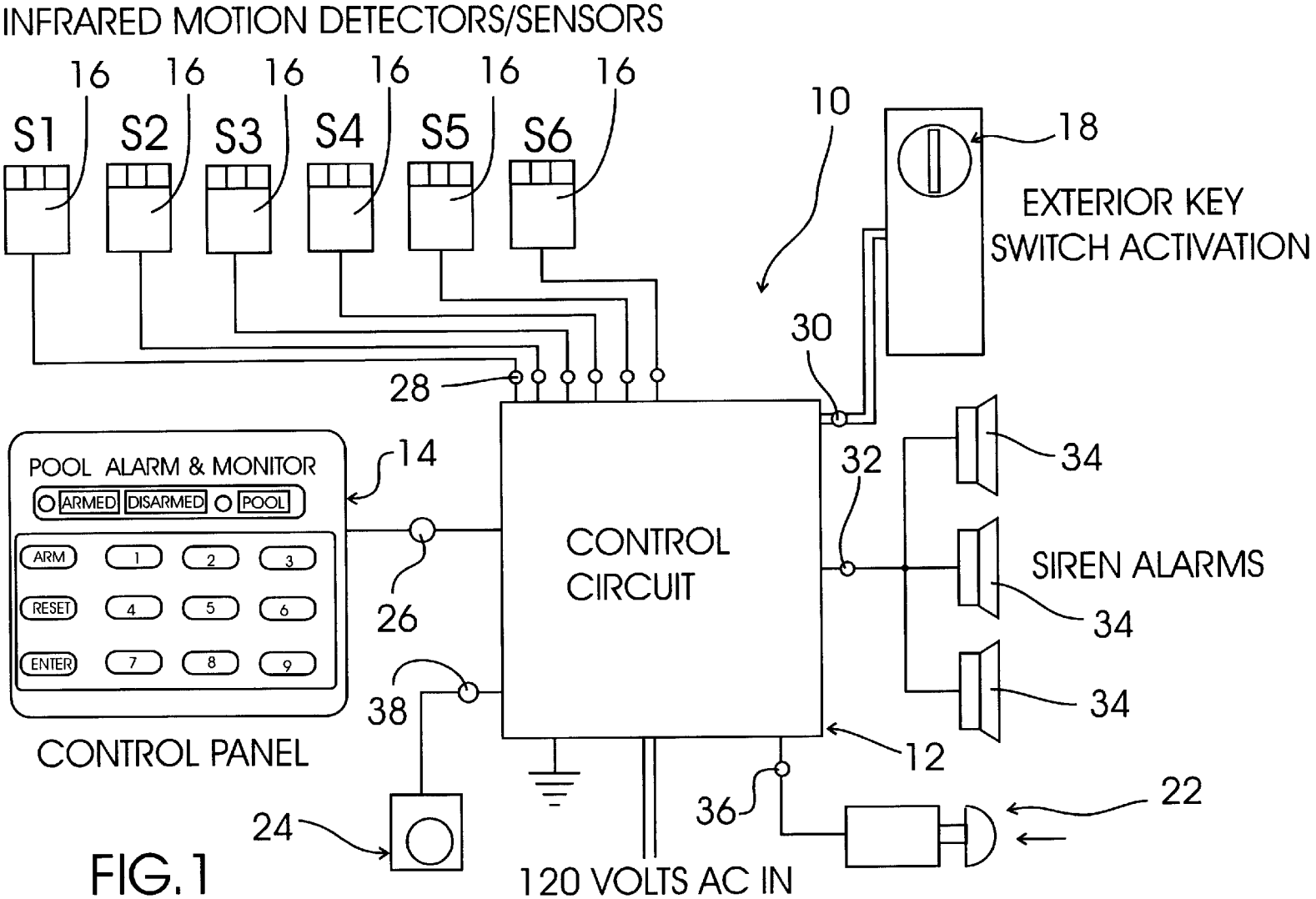
FIG. 1 is a schematic diagram of an exemplary embodiment of the pool alarm system of the present invention showing the programmable control circuit, the control keypad, a number of planar focused infrared motion detectors, a key alarm system activation switch, an audible alarm output system, a drain blockage sensor, and a pool pump motor control relay; the programmable control circuit including a keypad input in connection with the control keypad, a number of motion detector inputs, each in connection with one of the number of planar focused infrared motion detectors, a circuit activation input in connection with the key alarm system activation switch, a speaker drive output in connection with the audible alarm output system, a drain stoppage input in connection with the drain blockage sensor, and a pump motor control output in connection with the pool pump motor control relay; each of the number of planar focused infrared motion detectors having an infrared sensing area having a planar bottom to allow for sensing motion at or a near a pool water surface; each of the planar focused infrared motion detectors generating an alarm trigger signal to one of the motion detector inputs of the programmable control circuit when motion is detected in the infrared sensing area; the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch; a force generated by pump suction being sufficient to pull the perforated dome shaped cover member downward to a triggering position when the perforations through the perforated dome shaped cover member are blocked by a trapped child or pet; the programmable control circuit being programmed to generate an audible alarm on the speaker drive output in connection with the audible alarm output system after receiving the alarm trigger signal from one of the planar focused infrared motion detectors on an infrared detector input; the programmable control circuit being programmed to open the pump motor control relay to disable a pool pump and to generate an audible alarm on the speaker drive output when a drain blocked signal is received on the drain stoppage input from the drain blockage sensor.

FIG. 1 shows an exemplary embodiment of the pool alarm system of the present invention generally designated 10. Pool alarm system 10 includes a programmable control circuit, generally designated 12; a control keypad, generally designated 14; six planar focused infrared motion detectors, each generally designated 16; a key alarm system activation switch, generally designated 18; an audible alarm output system, generally designated 20; a drain blockage sensor, generally designated 22; and a pool pump motor control relay, generally designated 24.

Programmable control circuit 12 is a conventional programmable alarm board having a keypad input 26 in connection with control keypad 14; six motion detector inputs 28 each in connection with one of the six of planar focused infrared motion detectors 16; a circuit activation input 30 in connection with key alarm system activation switch 18; a speaker drive output 32 in connection with each of the three speakers 34 of audible alarm output system 20; a drain stoppage input 36 in connection with drain blockage sensor 22; and a pump motor control output 38 in connection with pool pump motor control relay 24.

Figure 3:
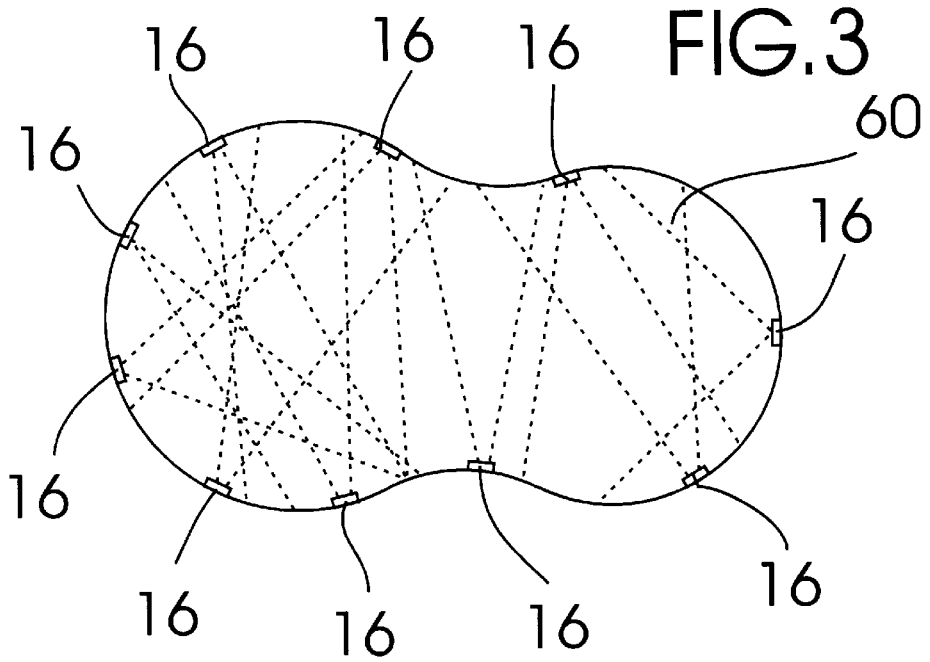
FIG. 3 is a schematic view showing positioning of a number of planar focused infrared motion detectors attached to the perimeter edge of a representative swimming pool and arranged in a preferred sensing pattern.

Each of the six of planar focused infrared motion detectors 16 has an infrared sensing area having a planar bottom to allow for sensing motion at or a near a pool water surface. Each of the planar focused infrared motion detectors generates an alarm trigger signal to its respective one of the motion detector inputs 28 of programmable control circuit 12 when motion is detected in the infrared sensing area. Referring to FIG. 3, in use motion detectors 16 are secured to the perimeter edge of a pool 60 such that the infrared sensing areas of the planar focused infrared motion detectors 16 cover a large percentage of the pool surface.

Figure 2:
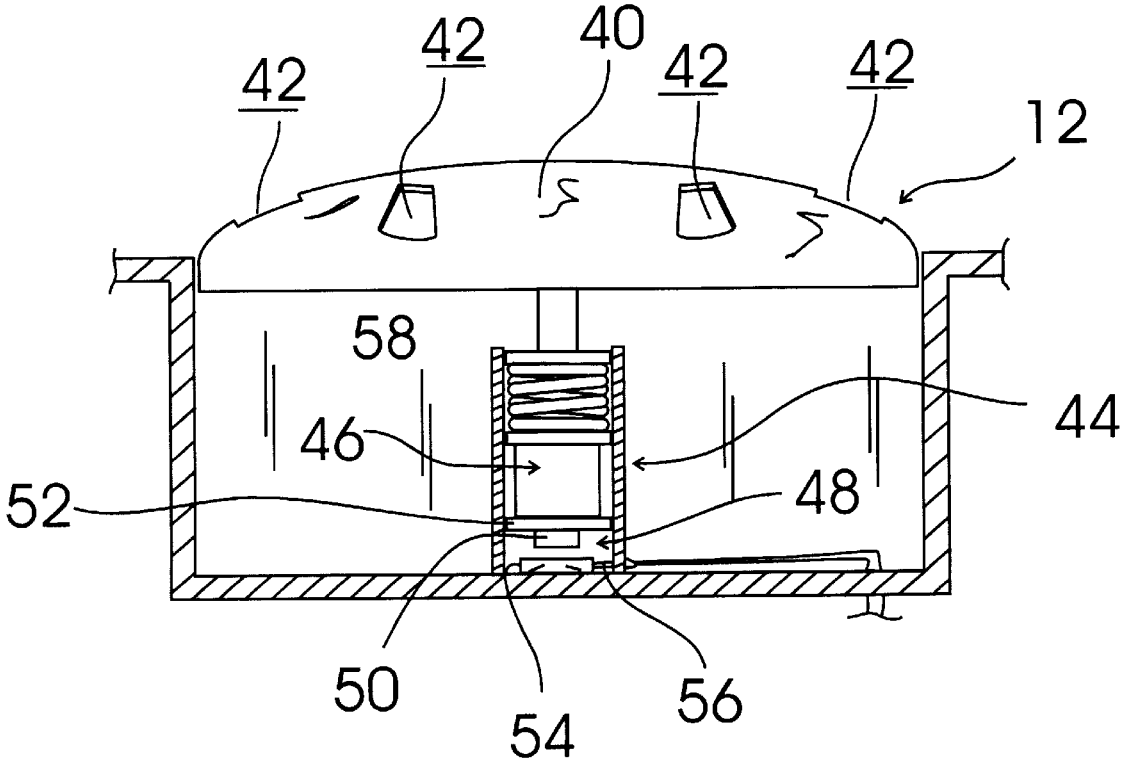
FIG. 2 is a detail view of an exemplary embodiment of the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch.

Referring to FIG. 2, drain blockage sensor 12 includes a perforated dome shaped cover member 40, having a number of perforated water flow holes 42 therethrough, slidably mounted to a compression detector, generally designated 44 including a spring biased plunger, generally designated 46, slidably mounted within a plunger cylinder, generally designated 48. Spring biased plunger 46 has a permanent magnet 50 secured to a plunger bottom surface 52 thereof. Plunger cylinder 48 has a magnetically actuated reed switch 54 in electrical connection with the drain stoppage input 36 (FIG. 1) of programmable control circuit 12 and positioned on a bottom cylinder surface 56 thereof. A spring 58 biases spring biased plunger 46 away from reed switch 54 to an extended position such that permanent magnet 50 does not close reed switch 54. A force generated by pump suction being sufficient to pull the perforated dome shaped cover member 40 downward to a triggering position when the perforations 42 through perforated dome shaped cover member 40 are blocked by a trapped child or pet.

Referring generally to FIGS. 1–3, programmable control circuit 12 is programmed to generate an audible alarm on the speaker drive output 32 in connection with the audible alarm output system 20 after receiving the alarm trigger signal from one of the planar focused infrared motion detectors 16 on an infrared detector input 28; and to open pump motor control relay 24 to disable a pool pump and to generate an audible alarm on speaker drive output 32 when a drain blocked signal is received on drain stoppage input 36 from drain blockage sensor 22. Control keypad and key alarm system activation switch 18 are used to activate and deactivate alarm system 10.

It can be seen from the preceding description that a pool alarm system has been provided that includes a programmable control circuit, a control keypad, a number of planar focused infrared motion detectors, a key alarm system activation switch, an audible alarm output system, a drain blockage sensor, and a pool pump motor control relay; the programmable control circuit including a keypad input in connection with the control keypad, a number of motion detector inputs, each in connection with one of the number of planar focused infrared motion detectors, a circuit activation input in connection with the key alarm system activation switch, a speaker drive output in connection with the audible alarm output system, a drain stoppage input in connection with the drain blockage sensor, and a pump motor control output in connection with the pool pump motor control relay; each of the number of planar focused infrared motion detectors having an infrared sensing area having a planar bottom to allow for sensing motion at or a near a pool water surface; each of the planar focused infrared motion detectors generating an alarm trigger signal to one of the motion detector inputs of the programmable control circuit when motion is detected in the infrared sensing area; the drain blockage sensor including a perforated dome shaped cover member slidably mounted to a compression detector including a spring biased plunger slidably mounted within a plunger cylinder; the spring biased plunger having a permanent magnet secured to a plunger bottom surface thereof; the plunger cylinder having a magnetically actuated reed switch in electrical connection with the drain stoppage input of the programmable control circuit and positioned on a bottom cylinder surface thereof; the spring biasing the spring biased plunger away from the reed switch to an extended position such that the permanent magnet does not close the reed switch; a force generated by pump suction being sufficient to pull the perforated dome shaped cover member downward to a triggering position when the perforations through the perforated dome shaped cover member are blocked by a trapped child or pet; the programmable control circuit being programmed to generate an audible alarm on the speaker drive output in connection with the audible alarm output system after receiving the alarm trigger signal from one of the planar focused infrared motion detectors on an infrared detector input; the programmable control circuit being programmed to open the pump motor control relay to disable a pool pump and to generate an audible alarm on the speaker drive output when a drain blocked signal is received on the drain stoppage input from the drain blockage sensor.

It is noted that the embodiment of the pool alarm system described herein in detail for exemplary purposes is of course subject to many different variations in structure, design, application and methodology. Because many varying and different embodiments may be made within the scope of the inventive concept(s) herein taught, and because many modifications may be made in the embodiment herein detailed in accordance with the descriptive requirements of the law, it is to be understood that the details herein are to be interpreted as illustrative and not in a limiting sense.

What is claimed is:

1. A pool alarm system comprising:

a programmable control circuit;

a control keypad;

a number of planar focused infrared motion detectors;

a key alarm system activation switch, an audible alarm output system;

a drain blockage sensor; and a pool pump motor control relay;

said programmable control circuit including a keypad input in connection with said control keypad, a number of motion detector inputs, each in connection with one of said number of planar focused infrared motion detectors, a circuit activation input in connection with said key alarm system activation switch, a speaker drive output in connection with said audible alarm output system, a drain stoppage input in connection with said drain blockage sensor, and a pump motor control output in connection with said pool pump motor control relay;

each of said number of planar focused infrared motion detectors having an infrared sensing area having a planar bottom to allow for sensing motion at or a near a pool water surface;

each of said planar focused infrared motion detectors generating an alarm trigger signal to one of said motion detector inputs of said programmable control circuit when motion is detected in said infrared sensing area;

said drain blockage sensor including a perforated dome shaped cover member slidably mounted to a compression detector including a spring biased plunger slidably mounted within a plunger cylinder;

said spring biased plunger having a permanent magnet secured to a plunger bottom surface thereof;

said plunger cylinder having a magnetically actuated reed switch in electrical connection with said drain stoppage input of said control circuit and positioned on a bottom cylinder surface thereof;

said spring biasing said spring biased plunger away from said reed switch to an extended position such that said permanent magnet does not close said reed switch;

a force generated by pump suction being sufficient to pull said perforated dome shaped cover member downward to a triggering position when said perforations through said perforated dome shaped cover member are blocked by a trapped child or pet;

said programmable control circuit being programmed to generate an audible alarm on said speaker drive output in connection with said audible alarm output system after receiving said alarm trigger signal from one of said planar focused infrared motion detectors on an infrared detector input;

said programmable control circuit being programmed to open said pump motor control relay to disable a pool pump and to generate an audible alarm on said speaker drive output when a drain blocked signal is received on said drain stoppage input from said drain blockage sensor.

* * * * *